United States Patent [19]

Chikuma

[11] Patent Number: 4,488,092

[45] Date of Patent: Dec. 11, 1984

[54] ILLUMINATION MODE SELECTING DEVICE FOR ILLUMINATION LAMP

[76] Inventor: Toichi Chikuma, 11-9-703,Sendagaya 4 Chome, Shibuya-ku, Tokyo, Japan, 151

[21] Appl. No.: 390,078

[22] Filed: Jun. 18, 1982

[30] Foreign Application Priority Data

| | | | |
|---|---|---|---|
| Jul. 21, 1981 | [JP] | Japan | 56-108243[U] |
| Mar. 5, 1982 | [JP] | Japan | 57-33797 |
| Mar. 8, 1982 | [JP] | Japan | 57-35081 |

[51] Int. Cl.[3] ..... H05B 41/38

[52] U.S. Cl. ..... 315/324; 315/313; 315/320; 315/127; 315/201; 315/315; 315/310

[58] Field of Search ..... 315/324, 313, 201, 320, 315/360, 362, 310; 315/127, 121, 311, 315

[56] References Cited

U.S. PATENT DOCUMENTS 3,927,348 12/1975 Zawadski ..... 315/201 X

FOREIGN PATENT DOCUMENTS

| | | | |
|---|---|---|---|
| 52-42655 | 4/1977 | Japan | 315/324 |
| 54-70663 | 6/1979 | Japan | 315/313 |
| 2069779 | 8/1981 | United Kingdom | 315/324 |

*Primary Examiner*—David K. Moore
*Assistant Examiner*—Vincent DeLuca
*Attorney, Agent, or Firm*—Wenderoth, Lind & Ponack

[57] ABSTRACT

An illumination mode selecting device for an illumination lamp having more than one individual illumination element is arranged so as to enable an operator to remotely control the number of illumination elements to be lit without special wiring between the remote control and the illumination lamp. A mode selector consists of a switch in parallel with an impedance. The mode selector is placed in series with an A.C. line connected between an A.C. power source and the illumination lamp. The speed of operation of the switch of the mode selector determines the mode of operation of the illumination lamp, that is the number of separate illumination elements which are to be lit.

3 Claims, 2 Drawing Figures

ILLUMINATION MODE SELECTING DEVICE FOR ILLUMINATION LAMP

BACKGROUND OF THE INVENTION

1. Field of the Invention

The present invention relates to an illumination mode selecting device for an illumination lamp having a plurality of illumination elements.

2. Description of the Prior Art

A change of the number of illumination elements of a lamp, such as fluorescent tubes of a fluorescent lamp, which are to be lit at one time, is sometimes desired for reasons such as energy economy.

For a fluorescent lamp having, for example, two fluorescent tubes, there are three operation modes, a non-tube illumination mode, a one-tube illumination mode and a two-tube illumination mode. In switching the operation of the illumination lamp between these three modes, a conventional method is to use a pull type switch originally equipped on the lamp. Another conventional method is to switch the illumination mode using an external switch device which is specially provided on a power distribution panel mounted on a wall or the like.

The use of the pull type switch, however, requires that the lamp itself is provided at a height from a floor which is low enough to allow the access of an operator to a string of the pull type switch and the operator must move to a position beneath the lamp. Furthermore, in case where a plurality of lamps are provided, the pull type switches thereof have to be operated respectively which is troublesome.

The use of the externally provided switch device requires special wiring between each fluorescent tube and the external switch device on the power distribution panel, causing the total cost of manufacturing the illumination system to be increased.

SUMMARY OF THE INVENTION

An object of the present invention is to resolve the problems inherent to the conventional illumination mode switching system by providing a illumination mode selecting device by which a plurality of illumination elements can be remotely controlled without requiring special wiring therefor.

According to the present invention, an illumination mode selecting device comprises mode selecting switch having one terminal connected to a power source, an impedance element connected in parallel with the mode selecting switch, a rectifier for rectifying an a.c. voltage supplied from the power source through the mode selecting switch or the impedance element, a thyristor connected between output terminals of the rectifier, an ignition circuit connected in parallel to the thyristor and a timer circuit connected to the ignition circuit. The timer circuit is energized upon a conduction of the thyristor and starts a timing operation immediately after the thyristor is turned off to make the ignition circuit inoperative for a predetermined time period.

In the illumination mode selecting device according to the present invention, the value of the impedance element is selected such that when the mode selecting switch is closed and an a.c. voltage is applied directly to the rectifier, the ignition circuit operates to ignite the thyristor connected to the latter and when the mode selecting switch is opened and the a.c. voltage applied to the rectifier and hence a d.c. voltage applied across the thyristor is reduced due to the presence of the impedance, and the thyristor is turned off. The timer circuit commences its timing operation at the turning-off of the thyristor to make the ignition circuit inoperative for the predetermined time period so that the thyristor can not be ignited during the time period even if the d.c. voltage applied thereacross is restored.

A circuit portion of the present illumination mode selecting device which includes the mode selecting switch and the impedance element connected in parallel thereto may be provided on the power distributor and connected to the power switch, and the other circuit portion including the rectifier, the thyristor, the ignition circuit and the timer circuit may be incorporated in each illumination lamp having, for example, two illumination elements and associated with one of the illumination elements of the lamp. With this arrangement of the present illumination mode selecting device, the illumination lamp operates in the two-element illumination mode in which both of the illumination elements can be lit by closing the power switch and the mode selecting switch, and then operates in the one-element illumination mode by opening the mode selecting switch and closing it again within the predetermined time period from the initial opening thereof.

In the latter case, when the re-closing of mode selecting switch is made after the predetermined time period, the operation becomes the two-element illumination mode.

Therefore, the illumination mode selecting device according to the present invention causes a remote switching of the lamp operation between the two-element illumination mode, the one-element illumination mode and the no-element illumination mode without requiring special wiring therefor. By providing a plurality of combination circuits each including the rectifier, the thyristor, the ignition circuit and the timer circuit of the illumination mode selecting device, it is possible to control a lamp having two or more illumination elements.

DETAILED DESCRIPTION OF THE PREFERRED EMBODIMENTS

Figure 1:
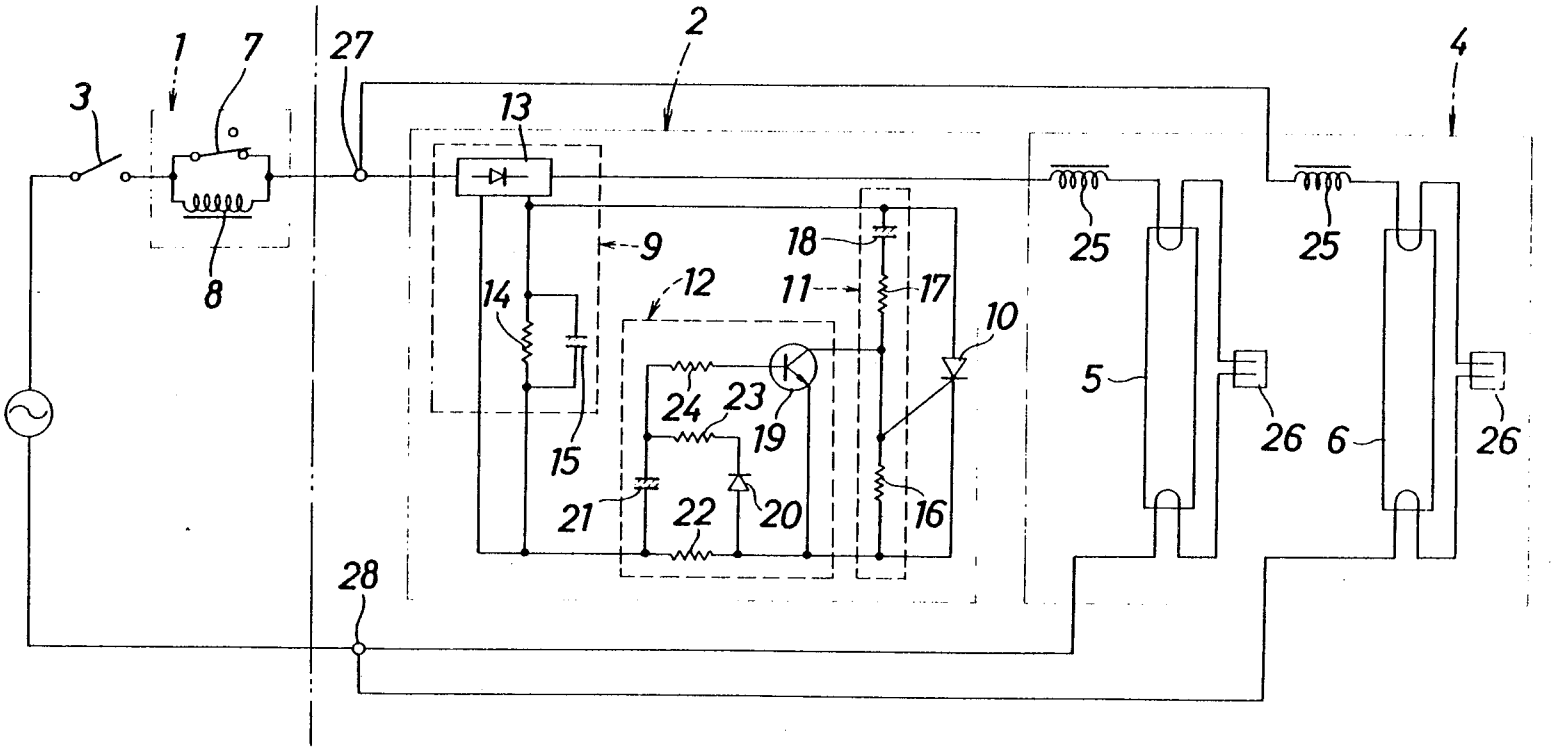
FIG. 1 is a circuit diagram of one embodiment of the present invention.

The illumination mode selecting device according to the present invention is shown in FIG. 1 as being applied to a control of a fluorescent lamp 4 having a pair of fluorescent tubes 5 and 6, which comprises a switching operation portion 1 and a control portion 2. The switching operation portion 1 may be disposed in a power distributor side and is connected to a power switch 3 provided on the power distributor. The control portion 2 is connected to one (5) of the fluorescent tubes 5 and 6 of the fluorescent lamp 4.

The switching operation portion 1 comprises an illumination mode selecting switch 7 and an impedance element 8, such as an inductor, connected in parallel with the mode selecting switch 7. One end of the parallel circuit is connected to the power switch 3 connected to a commercial power source.

The control portion 2 comprises a rectifier 9 having an a.c. input terminal connected to the other end of the parallel circuit and the other input terminal connected through the fluorescent tube 5 having an inductor 25 and a glow starter 26 to the power source, a thyristor 10 connected between d.c. output terminals of the rectifier 9, an ignition circuit 11 connected in parallel with the thyristor 10 and a timer circuit 12. The fluorescent tube 6 having an inductor 25 and a glow starter 26 is connected between circuit points 27 and 28.

The rectifier 9 comprises a diode bridge circuit 13 and a resistor 14 connected between the d.c. output terminals of the bridge circuit 13 and a capacitor 15 connected in parallel to the resistor 14.

The ignition circuit 11 is composed of a series circuit of resistors 16 and 17 and a capacitor 18. A gate terminal of the thyristor 10 is connected to a junction of the series resistors 16 and 17.

A series circuit of the thyristor and a small resistor 22 which constitutes a portion of the timer circuit 12 is connected in parallel to the resistor 14.

The timer circuit 12 is composed of a transistor 19 having a collector connected to the junction between the resistors 16 and 17 of the ignition circuit 11 and emitter connected to the cathode of the thyristor 10, a diode 20 having an anode connected to the cathode of the thyristor 10 and a cathode connected through resistors 23 and 24 to a base of the transistor 19 and the resistor 22 having one end connected to the anode of the diode 20 and the other end connected through a capacitor 21 to a junction between the series resistors 23 and 24.

The value of the impedance element 8 connected in parallel to the mode selecting switch 7 should be selected so as to produce a voltage drop thereacross, when incorporated in the circuit, which is large enough to produce a d.c. voltage drop across the thyristor 10, which is large enough to turn the latter off.

With the circuit arrangement mentioned above, when the power switch 3 and the mode selecting switch 7 are closed, a source voltage is directly applied across the fluorescent tube 6 to light it in the usual manner. On the other hand, the a.c. voltage is applied across the fluorescent tube 5 indirectly through an impedance circuit composed of the parallel circuit of the resistor 14, the capacitor 15 and the thyristor 10. Since the value of the resistor 14 is selected as being relatively large, the portion of the a.c. voltage which is applied across the fluorescent tube 5 is lower than its operating voltage and therefore the tube 5 can not be lit if the thyristor 10 is in the off state. However, since a d.c. voltage produced across the resistor 14 is applied across the parallel circuit of the thyristor 10 and the ignition circuit 11, a d.c. current flows through the capacitor 18, the resistor 17 and the resistor 16 for a short time determined by an RC times constant of the ignition circuit 11, causing a positive potential to be produced at the junction between the resistors 16 and 17. With this positive potential, an ignition current is allowed to flow to the gate of the thyristor 10 and thus the thyristor 10 is ignited and turns on. Therefore, the impedance connected in series to the fluorescent tube 5 is lowered to the value of the resistor 22 which is much smaller than the resistor 14. Thus, the fluorescent tube 5 is lit upon the conduction of the thyristor 10 due to the closure of the mode selecting switch 7, so that the present system operates in the two-element illumination mode.

A portion of the d.c. current flowing through the thyristor 10 flows through a series conduit of the diode 20, the resistor 24 and the capacitor 21 for a short time determined by an RC time constant thereof to charge capacitor 21. Therefore, a forward bias voltage is applied to the base of the transistor 19 making the latter conductive. That is, the transistor 19 is conductive during the time that the thyristor 10 is in the "on" state. Further, for a short time period T after the thyristor 10 turns off, the transistor 19 is kept conductive. The time period T is determined by an RC time constant of the capacitor 21 and the resistor 24. During time that the transistor 19 is conductive, the resistor 16 of the ignition circuit 11 is short-circuited and the gate and the cathode of the thyristor are kept in the same potential level.

In this state, when the mode selecting switch 7 is opened, the thyristor 10 is turned off as mentioned before. Therefore, the fluorescent tubes 5 extinguishes and the brightness of the fluorescent tube 6 reduces.

Figure 2:
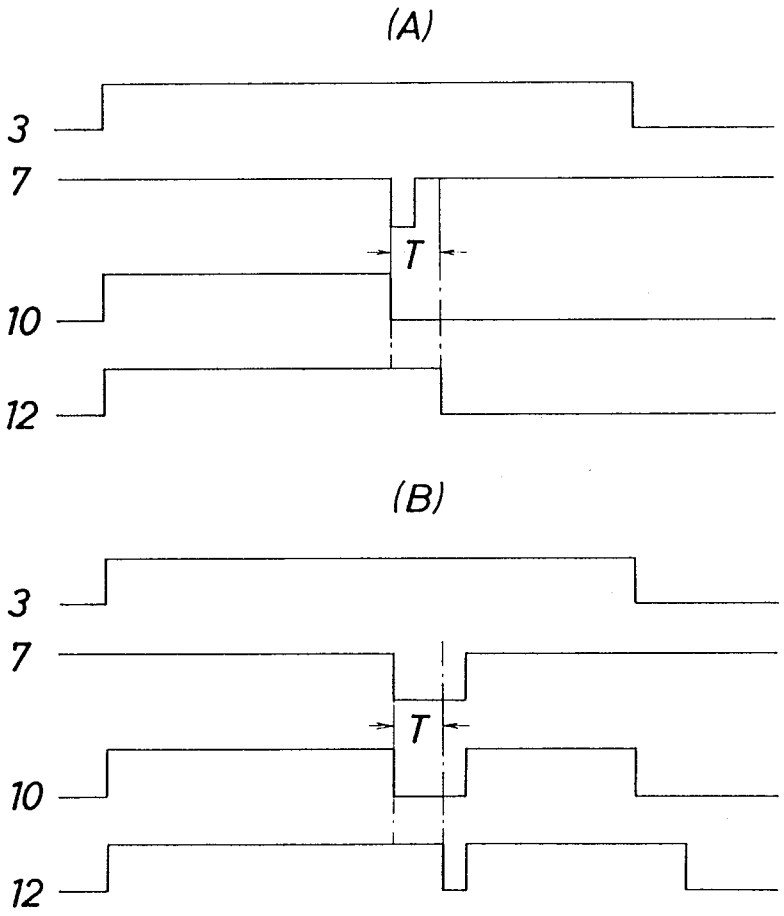
FIGS. 2A and 2B show different operation mode of the illumination mode selecting device in FIG. 1.

Then, when the mode selecting switch 7 is closed again within the time period T, the brightness of the fluorescent tube 6 is restored. However, since the transistor 19 of the timer circuit 12 is still conductive, the resistor 16 of the ignition circuit 11 is kept short-circuited by the collector-emitter circuit of the transistor 19. Therefore, the thyristor 10 can not be ignited and thus the fluorescent tube 5 is kept extinguished. Thus, the lamp operates in the one-element illumination mode. This is shown in FIG. 2A.

When the time instant at which the mode selecting switch 7 is closed again is after the time period T is lapsed, the brightness of the fluorescent tube 6 is restored and the fluorescent tube 5 is lit because the ignition circuit 11 can operate to ignite the thyristor 10. Therefore, the lamp can operate in the two-element illumination mode. This mode is shown in FIG. 2B.

As will be clear from the foregoings, according to the present invention, it is possible to remote-control a plurality of lamps each having a plurality of illumination elements by a mere on-off operation of the mode selecting switch 7 provided on the power distribution panel. This is, by providing on the distribution panel, a combination of the mode selecting switch, the rectifier, the thyristor, the ignition circuit therefor and the timer circuit for each lamp and by merely operating the mode selecting switch, it is possible to remotely switch the operation of the lamp between the one-element illumination mode, the two-element illumination mode and the no-element illumination mode, without requiring any additional wiring between the lamps and the power distribution panel.

The illumination mode selecting device of the present invention comprises the operation portion 1 and the control portion 2 which can be assembled as separate units is very simple in construction and inexpensive in manufacture, and it is readily possible to attach these portion to the commercially available lamp or to the existing power distribution panel, or these units are separately attached thereto respectively.

Although the present invention has been explained with reference to the embodiment applied to a lamp having two illumination elements, it may be obvious that this invention can also be applied to a lamp having three elements or more, provided that a plurality of the control portions each including a timer circuit having a different time period are prepared for illumination elements, respectively, so that a multistage illumination mode selection is possible by operating the mode selecting switch in different manners corresponding to the times between the opening and re-closing of the mode selecting switch.

Although the present invention has been explained as being applied to the fluorescent lamp, it should be noted that this invention is also applicable to illumination devices other than a fluorescent lamp.

What is claimed is:

1. An illumination mode selection device for an illumination lamp system including a plurality of illumination elements connected in parallel to an A.C. power source, comprising:

a power switch;

a mode selecting means having one terminal connected to said power switch and having another terminal connected to one terminal of a preselected number of said plurality of illumination elements, said mode selecting means having an impedance which is selectively changeable between a high value and a low value;

a rectifier means having a pair of A.C. input terminals and a pair of D.C. output terminals, one of said A.C. input terminals being connected to said another terminal of said mode selecting means and the other of said pair of A.C. input terminals being connected to at least one of said plurality of illumination elements; and a control circuit connected between said D.C. output terminals of said rectifier means, said control circuit including a thyristor, a load resistor for said thyristor, an ignition circuit for said thyristor to ignite said thyristor when an A.C. input voltage is applied to said pair of A.C. input terminals of said rectifier means and a timer circuit for prohibiting said thyristor from being turned-on for a predetermined period of time after said impedance of said mode selecting means is changed from said high value to said low value.

2. An illumination mode selection device as claimed in claim 1, wherein said mode selecting means comprises an on-off switch and a reactive impedance connected in parallel with said on-off switch.

3. An illumination mode selection device as claimed in claims 1 or 2, wherein said ignition circuit includes a series connection of a capacitor and a first resistor and a second resistor, said ignition circuit being connected in parallel with said thyristor and a gate of said thyristor being connected to a junction of said first and second resistors, and wherein said timer circuit includes a time constant circuit connected across said load resistor of said thyristor for providing said predetermined time period and includes a transistor having a base connected to said time constant circuit and a collector connected to said junction of said first and second resistors so that said thyristor is prevented from being turned-on for said predetermined time after said impedance of said mode selecting means is switched from said high value to said low value.

* * * * *